United States Patent [19]

Smith

[11] Patent Number: 5,055,219

[45] Date of Patent: Oct. 8, 1991

[54] VISCOELASTIC CLEANING COMPOSITIONS AND METHODS OF USE THEREFOR

[75] Inventor: William L. Smith, Pleasanton, Calif.

[73] Assignee: The Clorox Company, Oakland, Calif.

[21] Appl. No.: 121,549

[22] Filed: Nov. 17, 1987

[51] Int. Cl.[5] ..... C11D 17/08; C11D 7/54

[52] U.S. Cl. ..... 252/102; 252/95; 252/106; 252/547; 252/142

[58] Field of Search ..... 252/173, 95, 547, 102, 252/526, 527, 545, 546, 186.43, 187.23, 187.24, 187.31, 142, 106, DIG. 14, 8.75

[56] References Cited

U.S. PATENT DOCUMENTS

| | | | |
|---|---|---|---|
| 2,834,737 | 5/1958 | Farkas | 252/187 |
| 3,523,826 | 8/1970 | Lissant | 134/22 |
| 3,560,389 | 2/1971 | Hunting | 252/95 |
| 3,697,431 | 10/1972 | Summerfelt | 252/103 |
| 4,080,305 | 3/1978 | Holdt et al. | 252/103 |
| 4,113,645 | 9/1978 | DeSimone | 252/187 H |
| 4,271,030 | 6/1981 | Brierley et al. | 252/98 |
| 4,337,163 | 6/1982 | Schilp | 252/96 |
| 4,375,421 | 3/1983 | Rubin et al. | 252/110 |
| 4,388,204 | 6/1983 | Dimond et al. | 252/98 |
| 4,395,344 | 7/1983 | Maddox | 252/99 |
| 4,396,525 | 8/1983 | Rubin et al. | 252/174.25 |
| 4,399,050 | 8/1983 | Bentham et al. | 252/95 |
| 4,540,506 | 9/1985 | Jacobson et al. | 252/179.12 |
| 4,576,728 | 3/1986 | Stoddart | 252/102 |
| 4,587,032 | 5/1986 | Rogers | 252/174.17 |
| 4,588,514 | 5/1986 | Jones et al. | 252/98 |
| 4,610,800 | 9/1986 | Durham et al. | 252/174.12 |
| 4,800,036 | 1/1989 | Rose et al. | 252/102 |
| 4,842,771 | 6/1989 | Rörig et al. | 252/547 |

FOREIGN PATENT DOCUMENTS

| | | |
|---|---|---|
| 841936 | 9/1976 | Belgium . |
| 129980 | 5/1983 | European Pat. Off. . |
| 178931 | 4/1986 | European Pat. Off. . |
| 185528 | 6/1986 | European Pat. Off. . |
| 204472 | 12/1986 | European Pat. Off. . |
| 0233666 | 3/1989 | European Pat. Off. . |
| 260205 | 3/1988 | France . |
| 1128411 | 9/1967 | United Kingdom . |
| 1466560 | 3/1977 | United Kingdom . |
| 1548379 | 7/1979 | United Kingdom . |
| 2185036 | 7/1987 | United Kingdom . |

OTHER PUBLICATIONS

Hoffman et al., "Rheology of Surfactant Solutions", *Tenside Detergents* (22) 1985.

Hoffmann et al., "Viscoelastic Detergent Solutions from Rodlike Micelles", *ACS Symposium Series*, vol. 272 (1985).

Bayer et al., "The Influence of Solubilized Additives . . . ", *Advances in Colloid and Interface Science* vol. 26, 1986.

Sepulveda, "Absorbances of Solutions of Cationic Micelles and Organic Anions", *Jour. Colloid and Interface Science* vol. 46 (1974).

Sepulveda et al., "Effect of Temperature on the Viscosity of Cationic Micellar Solutions . . . ", *Jour. Colloid and Interface Science*, vol. 118 (1987).

Ekwall et al., "The Aqueous Cetyl Trimethylammonium Bromide Solutions", *Jour. Colloid and Interface Science* vol. 35 (1971).

Nash, "The Interaction of Some Naphthalene Derivatives . . . ", *Journal of Colloid Science* vol. 13 (1958).

Bunton et al., "Electrolyte Effects on the Cationic . . . ", *Journal of the American Chemical Society* vol. 95 (1973).

Gravsholt, "Viscoelasticity in Highly Dilute Aqueous Solutions . . . ", *Journal of Colloid and Interface Science* vol. 57 (1978).

Larsen et al., "A Highly Specific Effect or (sic) Organic Solutes . . . ", *Tetrahedron Letters*, vol. 29 (1973).

Wan, "Interaction of Substituted Benzoic Acids with Cationic Surfactants", *Jour. Pharmaceutical Science*, vol. 55 (1966).

Larsen et al., "Interactions of Some Aromatic Acids . . . ", *Journal Organic Chemistry*, vol. 41 (1976).

Gamboa et al., "High Viscosities of Cationic and Anionic Micellar Solutions . . . ", *Jour. Colloid and Interface Science*, vol. 113 (1986).

*Primary Examiner*—Josephine Barr

*Attorney, Agent, or Firm*—Michael J. Mazza; Joel J. Hayashida; Stephen M. Westbrook

[57] ABSTRACT

A thickened aqueous cleaning composition is viscoelastic, and has utility as a drain opening composition or as a hard surface cleaner having a cleaning-effective residence time on non-horizontal surfaces. In one embodiment the composition comprises a cleaning active, a quaternary ammonium compound, and an organic counterion. In another embodiment, the viscoelastic quality of the composition is advantageously utilized as a drain opener which rapidly penetrates standing water with minimal dilution to deliver active to the clog material.

14 Claims, No Drawings

VISCOELASTIC CLEANING COMPOSITIONS AND METHODS OF USE THEREFOR

BACKGROUND OF THE INVENTION

1. Field of The Invention

The present invention relates to thickened cleaning composition having a viscoelastic rheology, and in particular to such thickened cleaning compositions having a viscoelastic rheology which are formulated to have utility as drain cleaners, or which are formulated to have utility as hard surface cleaners.

2. Description of Related Art

Much art has addressed the Problem of developing a thickened cleaning composition, which may contain a bleach and may have utility as a hard surface cleanser. The efficacy of such compositions is greatly improved by viscous formulations, increasing the residence time of the cleaner. Splashing during application and use is minimized, and consumer preference for a thick product is well documented. Schilp U.S. Pat. No. 4,337,163 shows a hypochlorite thickened with an amine oxide or a quaternary ammonium compound, and a saturated fatty acid soap. Stoddart U.S. Pat. No. 4,576,728 shows a thickened hypochlorite including 3- or 4- chlorobenzoic acid, 4-bromobenzoic acid, 4-toluic acid and 3-nitrobenzoic acid in combination with an amine oxide. DeSimone U.S. Pat. No. 4,113,645 discloses a method for dispersing a perfume in hypochlorite using a quaternary ammonium compound. Bentham U.S. Pat. No. 4,399,050, discloses hypochlorite thickened with certain carboxylated surfactants, amine oxides and quaternary ammonium compounds. Jeffrey et al, GB 1466560 shows bleach with a soap, surfactants and a quaternary ammonium compound. For various reasons, the prior art thickened hypochlorite compositions are not commercially viable. In many instances, thickening is insufficient to provide the desired residence time on non-horizontal surfaces. Adding components, and/or modifying characteristics of dissolved components often creates additional problems with the composition, such as syneresis, which require adding further components in an attempt to correct these problems. Polymer thickened hypochlorite bleaching compositions tend to be oxidized by the hypochlorite. Prior art thickened bleach products generally exhibit phase instability at elevated (above about 100° F.) and/or low (below about 35° F.) storage temperatures. Difficulties exist with colloidal thickening agents in that these tend to exhibit either false-bodied or thixotropic rheologies, which, at high viscosities, can result in a tendency to set up or harden. Other hypochlorite compositions of the prior art are thickened with surfactants and may exhibit hypochlorite stability problems. Surfactant thickening systems also are not cost effective when used at the levels necessary to obtain desired product viscosity values. European Patent Application 0,204,479 to Stoddard describes shear-thinning compositions, and seeks to avoid viscoelasticity in such shear-thinning compositions.

Drain cleaners of the art have been formulated with a variety of actives in an effort to remove the variety of materials which can cause clogging or restriction of drains. Such actives may include acids, bases, enzymes, solvents, reducing agents, oxidants and thioorganic compounds. Such compositions are exemplified by U.S. Pat. No. 4,080,305 issued to Holdt et al; U.S. Pat. No. 4,395,344 to Maddox; Rogers U.S. Pat. No. 4,587,032; Jacobson U.S. Pat. No. 4,540,506 Durham U.S. Pat. No. 4,610,800 and European Patent Applications 0,178,931 and 0,185,528, both to Swann et al. Generally, workers in this field have directed their efforts toward actives, or combinations of actives, which would have improved efficacy or speed when used on typically-encountered clog materials; or are safer to use. A problem with this approach, however, is that regardless of the effectiveness of the active if the composition is not fully delivered to the clog, the effectiveness of the active will be diminished or destroyed. This is particularly apparent where the clogged drain results in a pool of standing water, and a drain opener composition added to such standing water will be substantially diluted thereby. The above European Patent Applications of Swann et al disclose an attempt to overcome the delivery problem by encapsulating actives in polymeric beads. The Rogers and Durham et al patents refer to the delivery Problem and mention that a thickener is employed to increase the solution viscosity and mitigate dilution. Similarly, a thickener is optionally included in the formulation of Jacobson et al.

SUMMARY OF THE PRESENT INVENTION

In view of the prior art, there remains a need for a thickened cleaning composition with a viscoelastic rheology, enabling its use as a drain cleaning composition. There further remains a need for a viscoelastic, thickened cleaning composition which is bleach and phase-stable, even at high viscosities and low temperatures, and can be economically formulated.

It is therefore an object of the present invention to provide a viscoelastic, thickened cleaning composition.

It is another object of the present invention to provide a cleaning composition having utility as a drain cleaner by virtue of a viscoelastic rheology.

It is another object of the present invention to provide a drain cleaning composition which is highly effective.

It is yet another object of the present invention to provide a viscoelastic thickened cleaning composition which is phase-stable during normal storage, and at elevated or very low temperatures, even in the presence of bleach.

It is another object of the present invention to provide a stable thickened hypochlorite composition with a viscoelastic rheology.

It is another object of the present invention to provide a viscoelastic thickening system which is effective at both high and low ionic strength.

It is another object of the present invention to provide a cleaning composition having a viscoelastic rheology to simplify filling of containers during manufacturing, and to facilitate dispensing by the consumer.

Briefly, a first embodiment of the present invention comprises a stable cleaning composition having a viscoelastic rheology comprising, in aqueous solution:

(a) an active cleaning compound;

(b) an alkyl quaternary ammonium compound with the alkyl group at least 14 carbon in length; and (c) an organic counterion.

It should be noted that as used herein the term "cleaning" refers generally to a chemical, physical or enzymatic treatment resulting in the reduction or removal of unwanted material, and "cleaning composition" specifically includes drain openers, hard surface cleaners and bleaching compositions. The cleaning composition may consist of a variety of chemically, physically or enzymatically reactive active ingredients, including solvents, acids, bases, oxidants, reducing agents, enzymes, detergents and thioorganic compounds.

Viscoelasticity is imparted to the cleaning composition by a system including a quaternary ammonium compound and an organic counterion selected from the group consisting of alkyl and aryl carboxylates, alkyl and aryl sulfonates, sulfated alkyl and aryl alcohols, and mixtures thereof. The counterion may include substituents which are chemically stable with the active cleaning compound. Preferably, the substituents are alkyl or alkoxy groups of 1–4 carbons, halogens and nitro groups, all of which are stable with most actives, including hypochlorite. The viscosity of the formulations of the present invention can range from slightly greater than that of water, to several thousand centipoise (cP). Preferred from a consumer standpoint is a viscosity range of about 20 cP to 1000cP, more preferred is about 50 cP to 500 cP.

A second embodiment of the present invention is a composition and method for cleaning drains, the composition comprising, in aqueous solution:

(a) a drain opening active;

(b) a viscoelastic thickener.

The composition is utilized by pouring an appropriate amount into a clogged drain. The viscoelastic thickener acts to hold the active components together, allowing the solution to travel through standing water with very little dilution. The viscoelastic thickener also yields increased percolation times through porous or partial clogs, affording longer reaction times to enhance clog removal.

In a third embodiment the present invention is formulated as a thickened hypochlorite-containing composition having a viscoelastic rheology, and comprises, in aqueous solution:

(a) a hypochlorite bleach;

(b) an alkyl quaternary ammonium compound with the alkyl group at least 14 carbons in length; and (c) a bleach-stable organic counterion.

Optionally in any embodiment an amine oxide or betaine surfactant may be included for increased thickening and improved low temperature phase stability.

It is an advantage of the present invention that the cleaning composition is thickened, with a viscoelastic rheology.

It is another advantage of the present invention that the viscoelastic thickener is chemically and phase-stable in the presence of a variety of cleaning actives, including hypochlorite, and retains such stability at both high and low temperatures.

It is another advantage of the present invention that the viscoelastic thickener yields a stable viscous solution at relatively low cost.

It is another advantage of the present invention that, when formulated as a drain cleaner the composition travels rapidly through standing water with minimal dilution, improving the efficacy of the cleaner.

It is another advantage of the present invention that the improved efficacy resulting from the viscoelastic rheology allows for safer drain cleaning formulations with lower levels of, or less toxic, actives.

It is a further advantage of the present invention that the viscoelastic thickener is effective at both high and low ionic strength.

It is a further advantage of the composition of the present invention that the viscoelasticity facilitates container filling, and dispensing, by reducing dripping.

It is yet another advantage of the composition of the present invention that thickening is achieved with relatively low levels of surfactant, improving chemical and physical stability.

These and other objects and advantages of the present invention will no doubt become apparent to those skilled in the art after reading the following Detailed Description of the Preferred Embodiments.

DETAILED DESCRIPTION OF THE PREFERRED EMBODIMENTS

In a first embodiment, the present invention is a thickened viscoelastic cleaner comprising, in aqueous solution;

(a) an active cleaning compound;

(b) an alkyl quaternary ammonium compound with the alkyl group at least 14 carbons in length; and (c) an organic counterion;

ACTIVE CLEANING COMPOUNDS

A number of cleaning compounds are known and are compatible with the viscoelastic thickener. Such cleaning compounds interact with their intended target materials either by chemical or enzymatic reaction or by physical interactions, which are hereinafter collectively referred to as reactions. Useful reactive compounds thus include acids, bases, oxidants, reductants, solvents, enzymes, thioorganic compounds, surfactants (detergents) and mixtures thereof. Examples of useful acids include: carboxylic acids such as citric or acetic acids, weak inorganic acids such as boric acid or sodium bisulfate, and dilute solutions of strong inorganic acids such as sulfuric acid. Examples of bases include the alkali metal hydroxides, carbonates, and silicates, and specifically, the sodium and potassium salts thereof. Oxidants, e.g., bleaches are a particularly preferred cleaning active, and may be selected from various halogen or peroxygen bleaches. Examples of suitable peroxygen bleaches include hydrogen peroxide and peracetic acids. Examples of enzymes include proteases, amylases, and cellulases. Useful solvents include saturated hydrocarbons, ketones, carboxylic acid esters, terpenes, glycol ethers, and the like. Thioorganic compounds such as sodium thioglycolate can be included to help break down hair and other proteins. Various nonionic, anionic, cationic or amphoteric surfactants can be included, as known in the art, for their detergent properties. Examples include taurates, sarcosinates and phosphate esters. Preferred cleaning actives are oxidants, especially hypochlorite, and bases such as alkali metal hydroxides. Most Preferred is a mixture of hypochlorite and an alkali metal hydroxide. The cleaning active as added in a cleaning-effective amount, which may range from about 0.05 to 50 percent by weight, depending on the active.

QUATERNARY AMMONIUM COMPOUND

The viscoelastic thickener is formed by combining a compound having a quaternary nitrogen, e.g. quaternary ammonium compounds (quats) with an organic counterion. The quat is selected from the group consisting of those having the following structures:

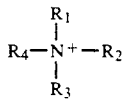

(i)

wherein $R_1$, $R_2$ and $R_3$ are the same or different, and are methyl, ethyl, propyl, isopropyl or benzyl, and $R_4$ is $C_{14-18}$;

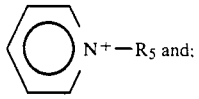

(ii)

wherein $R_5$ is $C_{14-18}$ alkyl, and;

(iii) mixtures thereof.

Most preferred, especially if ionic strength is present, is a $C_{14-18}$ alkyl trimethyl ammonium chloride and especially cetyltrimethyl ammonium chloride (CETAC). It is noted that when referring to carbon chain lengths of the quat or any other compound herein, the commercial, polydisperse forms are contemplated. Thus, a given chain length within the preferred $C_{14-18}$ range will be predominately, but not exclusively, the specified length. The pyridinium and benzyldimethyl ammonium headgroups are not preferred if ionic strength is high. Also, it is preferred that if $R_1$ is benzyl, $R_2$ and $R_3$ are not benzyl. Commercially available quats are usually associated with an anion. Such anions are fully compatable with the counterions of the present invention, and generally do not detract from the practice of the invention. Most typically, the anion is chloride and bromide, or methylsulfate. Where the cleaning active includes hypochlorite, however, the bromide anion is not preferred.

The quaternary ammonium compound is added at levels, which, when combined with the organic counterion are thickening effective. Generally about 0.1 to 10.0 weight percent of the quaternary ammonium compound is utilized, and preferred is to use about 0.3 to 3.0% quat.

ORGANIC COUNTERION

The organic counterion is selected from the group consisting of $C_{2-10}$ alkyl carboxylates, aryl carboxylates, $C_{2-10}$ alkyl sulfonates, aryl sulfonates, sulfated $C_{2-10}$ alkyl alcohols, sulfated aryl alcohols, and mixtures thereof. The aryl compounds are derived from benzene or napthalene and may be substituted or not. The alkyls may be branched or straight chain, and preferred are those having two to eight carbon atoms. The counterions may be added in acid form and converted to the anionic form in situ, or may be added in anionic form. Suitable substituents for the alkyls or aryls are $C_{1-4}$ alkyl or alkoxy groups, halogens, nitro groups, and mixtures thereof. Substituents such as hydroxy or amine groups are suitable for use with some non-hypochlorite cleaning actives, such as solvents, surfactants and enzymes. If present, a substituent may be in any position on the rings. If benzene is used, the para (4) and meta (3) positions are preferred. The counterion is added in an amount sufficient to thicken and result in a viscoelastic rheology, and preferably between about 0.01 to 10 weight percent. A preferred mole ratio of quat to counterion is between about 12:1 and 1:6, and a more preferred ratio is about 6:1 to 1:3. Without limiting to a particular theory, it is thought that the counterion promotes the formation of elongated micelles of the quat. These micelles can form a network which results in efficient thickening. It has been suprisingly found that the viscoelastic thickening as defined herein occurs only when the counterion is minimally or non surface-active. Experimental data shows that, generally, the counterions of the present invention should be soluble in water. Surface-active counterions normally don't work, unless they have a have a critical micelle concentration (CMC) greater than about 0.1 molar as measured in water at room temperature (about 70° F.). Counterions having a CMC less than this are generally too insoluble to be operable. For example, sodium and potassium salts of straight chain fatty acids (soaps), having a chain length of less than ten carbons, are suitable, however, longer chain length soaps generally don't work because their CMC's are less than about 0.1 molar. See Milton J. Rosen, *Surfactants and Interfacial Phenomena*, John Wiley and Sons.

Table 1 shows the effect on viscosity and phase stability of a number of different counterions. The quat in each example is CETAC, and about 5.5–5.8 weight percent sodium hypochlorite, 4–5 weight percent sodium chloride, and about 1.4–1.9 weight percent sodium hydroxide are also present.

TABLE I

Effect of Counterions

| | CETAC | Counterion | | Viscosity (cP) | | Number of Phases as Indicated Temp. (°F.) | | | | |
|---|---|---|---|---|---|---|---|---|---|---|
| No. | Wt. % | Wt. % | Name | 3 rpm | 30 rpm | 12 | 30 | 71 | 107 | 127 |
| 1 | 0.50 | | None | — | 14 | 2 | 2 | 1 | | |
| 2 | 0.50 | 0.010 | Acetic Acid | 90 | 74 | 2 | 2 | 1 | 1 | 1 |
| 3 | 0.50 | 0.200 | Acetic Acid | 100 | 81 | 2 | 2 | 1 | 1 | 1 |
| 4 | 0.50 | 0.050 | Butyric Acid | 100 | 76 | | | | | |
| 5 | 0.50 | 0.450 | Butyric Acid | 40 | 38 | 2 | 2 | 1 | 1 | 1 |
| 6 | 0.50 | 0.050 | Octanoic Acid | 50 | 40 | | | 1 | | |
| 7 | 0.50 | 0.200 | Octanoic Acid | 80 | 74 | | | 1 | | |
| 8 | 0.50 | 0.050 | Sodium Octylsulfonate | 220 | 165 | 2 | 2 | 1 | 1 | 1 |
| 9 | 0.50 | 0.100 | Sodium Octylsulfonate | 280 | 229 | 2 | 2 | 1 | 1 | 1 |
| 10 | 0.75 | 0.150 | Sodium Octylsulfonate | 400 | 353 | 2 | 2 | 1 | 1 | 1 |
| 11 | 0.48 | 0.180 | Benzoic Acid | — | 2 | | 2 | 1 | 1 | 1 |
| 12 | 0.48 | 0.170 | 4-Toluic Acid | 10 | 14 | | 1C | 1 | 1 | 1 |
| 13 | 0.22 | 0.200 | 4-Chlorobenzoic Acid | 400 | 135 | 2 | 2 | 1 | 1 | 1 |
| 14 | 0.30 | 0.300 | 4-Chlorobenzoic Acid | 960 | 202 | 2 | 2 | 1 | 1 | 1 |
| 15 | 0.50 | 0.050 | 4-Chlorobenzoic Acid | 380 | 213 | 2 | 2 | 1 | 1 | 1 |
| 16 | 0.50 | 0.125 | 4-Chlorobenzoic Acid | 2010 | 507 | | | 1 | | |
| 17 | 0.50 | 0.200 | 4-Chlorobenzoic Acid | 4450 | 850 | 2 | 2 | 1 | 1 | 1 |
| 18 | 0.50 | 0.250 | 4-Chlorobenzoic Acid | 4180 | 820 | | | 1 | | |
| 19 | 0.50 | 0.375 | 4-Chlorobenzoic Acid | 5530 | 1000 | | | 1 | | |

TABLE I-continued

Effect of Counterions

| No. | CETAC Wt. % | Counterion Wt. % | Counterion Name | Viscosity (cP) 3 rpm | Viscosity (cP) 30 rpm | Number of Phases as Indicated Temp. (°F.) 12 | 30 | 71 | 107 | 127 |
|---|---|---|---|---|---|---|---|---|---|---|
| 20 | 0.50 | 0.500 | 4-Chlorobenzoic Acid | 4660 | 770 | | | 1 | | |
| 22 | 0.50 | 0.625 | 4-Chlorobenzoic Acid | 3180 | 606 | | | 1 | | |
| 23 | 0.50 | 0.750 | 4-Chlorobenzoic Acid | 1110 | 341 | | | 1 | | |
| 24 | 0.50 | 0.875 | 4-Chlorobenzoic Acid | 170 | 125 | | | 1 | | |
| 25 | 0.50 | 1.000 | 4-Chlorobenzoic Acid | 30 | 20 | | | 1 | | |
| 26 | 0.70 | 0.100 | 4-Chlorobenzoic Acid | 250 | 167 | 2 | 2 | 1 | 1 | 1 |
| 27 | 0.70 | 0.300 | 4-Chlorobenzoic Acid | 4640 | 791 | 2 | 2 | 1 | 1 | 1 |
| 28 | 0.78 | 0.200 | 4-Chlorobenzoic Acid | 3110 | 622 | 2 | 2 | 1 | 1 | 1 |
| 29 | 1.20 | 0.300 | 4-Chlorobenzoic Acid | 940 | 685 | | 2 | 1 | 1 | 1 |
| 30 | 0.50 | 0.200 | 2-Chlorobenzoic Acid | 10 | 7 | | 2 | 1 | 1 | 1 |
| 31 | 0.50 | 0.200 | 2,4-Dichlorobenzoic Acid | 1920 | 658 | | 2 | 1 | 1 | 1 |
| 32 | 0.50 | 0.200 | 4-Nitrobenzoic Acid | 10 | 19 | | 2 | 1 | 1 | 1 |
| 33 | 0.48 | 0.210 | Salicylic acid | 1040 | 359 | 1C | 1C | 1 | 1 | 1 |
| 34 | 0.50 | 0.150 | Naphthoic Acid | 750 | 306 | 2 | 1C | 1 | | |
| 35 | 0.50 | 0.030 | Phthalic acid | 70 | 73 | 2 | 2 | 1 | 1 | 1 |
| 36 | 0.50 | 0.400 | Phthalic acid | 80 | 64 | 2 | 2 | 1 | 1 | 1 |
| 37 | 0.50 | 0.100 | Benzenesulfonic Acid | 40 | 46 | 2 | 2 | 1 | | |
| 38 | 0.50 | 0.200 | Benzenesulfonic Acid | 150 | 122 | 2 | 2 | 1 | | |
| 39 | 0.50 | 0.400 | Benzenesulfonic Acid | 220 | 175 | 2 | 1C | 1 | | |
| 40 | 0.50 | 0.100 | Toluenesulfonic Acid | 360 | 223 | 2 | 2 | 1 | 1 | 1 |
| 41 | 0.50 | 0.200 | Toluenesulfonic Acid | 370 | 260 | 2 | 2 | 1 | 1 | 1 |
| 42 | 0.50 | 0.300 | Toluenesulfonic Acid | 290 | 238 | | 2 | 1 | 1 | 1 |
| 43 | 0.50 | 0.150 | Sodium Cumenesulfonate | thick | | | | 2 | | |
| 44 | 0.50 | 0.030 | Sodium Xylenesulfonate | 150 | 119 | 2 | 2 | 2 | 1 | 1 |
| 45 | 0.50 | 0.100 | Sodium Xylenesulfonate | 610 | 279 | | 2 | 1 | 1 | 1 |
| 46 | 0.50 | 0.150 | Sodium Xylenesulfonate | 260 | 224 | | 2 | 1 | 1 | 1 |
| 47 | 0.50 | 0.200 | Sodium Xylenesulfonate | 130 | 123 | 2 | 2 | 1 | 1 | 1 |
| 48 | 0.97 | 0.630 | Sodium Xylenesulfonate | 100 | 120 | 1C | 1 | 1 | 2 | 2 |
| 49 | 0.50 | 0.050 | 4-Chlorobenzenesulfonate | 150 | 118 | 2 | 2 | 1 | | |
| 50 | 0.50 | 0.100 | 4-Chlorobenzenesulfonate | 420 | 248 | 2 | 1C | 1 | | |
| 51 | 0.50 | 0.200 | 4-Chlorobenzenesulfonate | 140 | 149 | 2 | 2 | 1 | | |
| 52 | 0.50 | 0.050 | Methylnaphthalenesulfonate | 290 | 202 | 2 | 2 | 1 | 1 | 1 |
| 53 | 0.50 | 0.100 | Methylnaphthalenesulfonate | 220 | 208 | 2 | 2 | 1 | 1 | 1 |
| 54 | 0.70 | 0.150 | Methylnaphthalenesulfonate | 480 | 390 | 2 | 2 | 1 | 1 | 1 |

CETAC = Cetyltrimethylammonium Chloride.
All formulas contain 0.113 wt. % of sodium silicate ($SiO_2/Na_2O$ = 3.22); 5.5-5.8% sodium hypochlorite, 4.3-4.7 wt. % sodium chloride and 1.4-1.9 wt. % sodium hydroxide.
Viscosities were measured at 72-81° F. with a Brookfield rotoviscometer model LVTD using spindle #2.
C = Cloudy Examples 15-25 and 44-47 of Table I show that viscosity depends on the ratio of counterion to quat. When the quat is CETAC and the counterion is 4-chlorobenzoic acid, maximum viscosity is obtained at a quat to counterion weight ratio of about 4:3. With CETAC and sodium xylene sulfonate, the ratio is about 5:1 by weight.

Preferred formulations of the present invention utilize a mixture of two or more counterions. Most preferably the counterion is a mixture of a carboxylate and a sulfonate, which surprisingly provides much better low temperature phase stability than either individually. As used herein sulfonate-containing counterions include the sulfated alcohol counterions. This is true even in the presence of ionic strength. Examples of such mixtures are shown in Table II. Examples of preferred carboxylates are benzoate, 4-chlorobenzoate, napthoate, 4-toluate and octanoate. Preferred sulfonates include xylenesulfonate, 4-chlorobenzenesulfonate and toluene sulfonate. Most preferred is a mixture of at least one of the group consisting of 4-toluate, 4-chlorobenzoic acid and octanoate with sodium xylenesulfonate. A preferred ratio of carboxylate to sulfonate is between about 6:1 to 1:6, more preferred is between about 3:1 to 1:3. Mixtures of counterions may also act to synergistically increase viscosity, especially at low ratios of counterion to quat. Such synergism appears in some cases even if one of the counterions results in poor phase stability or low viscosity when used alone. For example, samples 11 and 46 of Table 1 (benzoic acid and sodium xylenesulfonate, respectively) yield low viscosities (2 cP and 224 cP respectively) and are phase instable at 30° F. When combined, however, as shown by samples 3-5 of Table II. The formulations are all phase-stable even at 0° F., and sample 5 shows a much higher viscosity than that of the same components individually.

TABLE II

Effect of Mixed Counterions

| No. | CETAC Wt. % | Counterion Wt. % | Counterion Name | Counterion Wt. % | Counterion Name | Viscosity cP 3 rpm | Viscosity cP 30 rpm | Number of Phases as Indicated Temp. (°F.) 0 | 12 | 30 | 71 | 107 | 127 |
|---|---|---|---|---|---|---|---|---|---|---|---|---|---|
| 1 | 0.50 | 0.20 | Benzoic Acid | 0.20 | BSA | 170 | 136 | 2 | 2 | 1C | 1 | 1 | 1 |
| 2 | 0.50 | 0.30 | Benzoic Acid | 0.10 | 4-CBSA | 1070 | 408 | 1F | 1C | 1C | 1 | 1 | 1 |
| 3 | 0.60 | 0.24 | Benzoic Acid | 0.24 | SXS | 180 | 173 | 1F | 1C | 1 | 1 | 1 | 1 |
| 4 | 0.62 | 0.10 | Benzoic Acid | 0.32 | SXS | 100 | 74 | 1C | 1C | 1 | 1 | 1 | 1 |
| 5 | 0.62 | 0.45 | Benzoic Acid | 0.15 | SXS | 690 | 424 | 1C | 1C | 1 | 1 | 1 | 1 |
| 6 | 0.62 | 0.09 | 4-CBA | 0.20 | Benzoic Acid | 1340 | 429 | 1F | 1C | 1C | 1 | 1 | 1 |
| 7 | 0.62 | 0.09 | 4-CBA | 0.30 | p-Toluic Acid | 7680 | 2440 | 2 | 2 | 2 | 1 | 1 | 1 |

TABLE II-continued

Effect of Mixed Counterions

| No. | CETAC Wt. % | Counterion Wt. % | Counterion Name | Counterion Wt. % | Counterion Name | Viscosity cP 3 rpm | Viscosity cP 30 rpm | Number of Phases as Indicated Temp. (°F.) 0 | 12 | 30 | 71 | 107 | 127 |
|---|---|---|---|---|---|---|---|---|---|---|---|---|---|
| 8 | 0.62 | 0.09 | 4-CBA | 0.20 | 2-CBA | 1160 | 414 | 1C | 2 | 1C | 1 | 1 | 1 |
| 9 | 0.62 | 0.09 | 4-CBA | 0.20 | 4-NBA | 840 | 387 | 1C | 1C | 1 | 1 | 1 | 1 |
| 10 | 0.31 | 0.05 | 4-CBA | 0.10 | Naphthoic Acid | 790 | 290 | 1F | 1C | 1 | 1 | 1 | 1 |
| 11 | 0.62 | 0.09 | 4-CBA | 0.10 | Naphthoic Acid | 3400 | 1025 | 1F | 1C | 1C | 1 | 1 | 1 |
| 12 | 0.62 | 0.09 | 4-CBA | 0.30 | Naphthoic Acid | 5560 | 2360 | 2 | 2 | 1 | 1 | 1 | 1 |
| 13 | 0.50 | 0.10 | 4-CBA | 0.15 | Octanoic Acid | 60 | 54 | | | | 1 | 1 | 1 |
| 14 | 0.62 | 0.09 | 4-CBA | 0.20 | BSA | 2410 | 695 | 1F | 1C | 1C | 1 | 1 | 1 |
| 15 | 0.15 | 0.05 | 4-CBA | 0.05 | TSA | 140 | 56 | 2 | 2 | 2 | 1 | 1 | 1 |
| 16 | 0.30 | 0.10 | 4-CBA | 0.10 | TSA | 1140 | 270 | 2 | 2 | 1 | 1 | 1 | 1 |
| 17 | 0.50 | 0.20 | 4-CBA | 0.10 | TSA | 2520 | 625 | 2 | 2 | 2 | 1 | 1 | 1 |
| 18 | 0.30 | 0.08 | 4-CBA | 0.08 | SXS | 400 | 142 | 2 | 2 | 1 | 1 | 1 | 1 |
| 19 | 0.30 | 0.10 | 4-CBA | 0.10 | SXS | 635 | 142 | 2 | 2 | 2 | 1 | 1 | 1 |
| 20 | 0.30 | 0.12 | 4-CBA | 0.30 | SXS | 200 | 140 | 1F | 1 | 1 | 1 | 1 | 1 |
| 21 | 0.37 | 0.11 | 4-CBA | 0.22 | SXS | 470 | 270 | 2 | 1 | 1 | 1 | 1 | 1 |
| 22 | 0.48 | 0.06 | 4-CBA | 0.32 | SXS | 80 | 91 | 1F | 1C | 1 | 1 | 1 | 1 |
| 23 | 0.50 | 0.10 | 4-CBA | 0.18 | SXS | 440 | 344 | 1F | 1C | 1 | 1 | 1 | 1 |
| 24 | 0.50 | 0.10 | 4-CBA | 0.10 | SXS | 1100 | 313 | 2 | 2 | 2 | 1 | 1 | 1 |
| 25 | 0.50 | 0.12 | 4-CBA | 0.35 | SXS | 402 | 320 | 1F | 1 | 1 | 1 | 1 | 1 |
| 26 | 0.50 | 0.13 | 4-CBA | 0.50 | SXS | 250 | 221 | 1F | 1 | 1 | 1 | 1 | 1 |
| 27 | 0.50 | 0.15 | 4-CBA | 0.15 | SXS | 4760 | 1620 | 2 | 2 | 1 | 1 | 1 | 1 |
| 28 | 0.50 | 0.15 | 4-CBA | 0.25 | SXS | 970 | 382 | 2 | 2 | 1 | 1 | 1 | 1 |
| 29 | 0.50 | 0.15 | 4-CBA | 0.50 | SXS | 470 | 350 | 1F | 1 | 1 | 1 | 1 | 1 |
| 30 | 0.50 | 0.38 | 4-CBA | 1.13 | SXS | 60 | 45 | | 1 | 1 | 1 | 1 | 1 |
| 31 | 0.69 | 0.17 | 4-CBA | 0.45 | SXS | 720 | 576 | 1C | 1 | 1 | 1 | 1 | 1 |
| 32 | 0.69 | 0.20 | 4-CBA | 0.40 | SXS | 3140 | 894 | 1F | 1 | 1 | 1 | 1 | 1 |
| 33 | 0.82 | 0.13 | 4-CBA | 0.35 | SXS | 440 | 450 | 1F | 1C | 1 | 1 | 1 | 1 |
| 34 | 0.89 | 0.09 | 4-CBA | 0.31 | SXS | 520 | 531 | 1C | 2 | 1 | 1 | 1 | 1 |
| 35 | 0.90 | 0.13 | 4-CBA | 0.26 | SXS | 1950 | 1630 | 2 | 2 | 1 | 1 | 1 | 1 |
| 36 | 0.50 | 0.10 | 2-CBA | 0.15 | SXS | 140 | 128 | 1F | 2 | 1C | 1 | 1 | 1 |
| 37 | 0.62 | 0.10 | 2,4-D | 0.32 | SXS | 100 | 86 | 1F | 1C | 1 | 1 | 1 | 1 |
| 38 | 0.50 | 0.10 | 4-NBA | 0.20 | BSA | 310 | 206 | 1F | 2 | 1C | 1 | 1 | 1 |
| 39 | 0.50 | 0.10 | 4-NBA | 0.05 | 4-CBSA | 360 | 200 | 1F | 2 | 1C | 1 | 1 | 1 |
| 40 | 0.62 | 0.12 | 4-NBA | 0.32 | SXS | 100 | 95 | 1F | 1C | 1 | 1 | 1 | 1 |
| 41 | 0.50 | 0.20 | Phthalic acid | 0.10 | SXS | 180 | 165 | | 2 | 2 | 1 | 1 | 1 |
| 42 | 0.15 | 0.05 | Naphthoic Acid | 0.05 | SXS | 40 | 27 | 1F | 1C | 1 | 1 | 1 | 1 |
| 43 | 0.20 | 0.10 | Naphthoic Acid | 0.10 | SXS | 90 | 54 | 2 | 1C | 1 | 1 | 1 | 1 |
| 44 | 0.40 | 0.10 | Naphthoic Acid | 0.20 | SXS | 110 | 100 | 1C | 1C | 1 | 1 | 1 | 1 |
| 45 | 0.60 | 0.10 | Naphthoic Acid | 0.20 | SXS | 340 | 294 | 2 | 2 | 1 | 1 | 1 | 1 |
| 46 | 0.62 | 0.15 | Naphthoic Acid | 0.32 | SXS | 160 | 141 | 1C | 1C | 1 | 1 | 1 | 1 |
| 47 | 0.50 | 0.10 | Naphthoic Acid | 0.10 | 4-CBSA | 1210 | 356 | 1F | 1C | 1 | 1 | 1 | 1 |
| 48 | 0.50 | 0.15 | SXS | 0.20 | BSA | 190 | 135 | 2 | 2 | 1C | 1 | 1 | 1 |
| 49 | 0.50 | 0.04 | SXS | 0.06 | TSA | 400 | 212 | 2 | 2 | 2 | 1 | 1 | 1 |
| 50 | 0.50 | 0.12 | SXS | 0.08 | TSA | 250 | 224 | 2 | | 1 | 1 | 1 | 1 |
| 51 | 0.50 | 0.12 | SXS | 0.18 | TSA | 170 | 150 | 2 | 2 | 2 | 1 | 1 | 1 |
| 52 | 0.50 | 0.15 | SXS | 0.05 | 4-CBSA | 90 | 82 | 2 | 1C | 1 | 1 | 1 | 1 |
| 53 | 0.50 | 0.05 | Octanoic Acid | 0.20 | SXS | 180 | 166 | 1F | 1C | 1 | 1 | 1 | 1 |
| 54 | 0.50 | 0.10 | Octanoic Acid | 0.15 | SXS | 310 | 248 | 2 | 1C | 1 | 1 | 1 | 1 |
| 55 | 0.60 | 0.15 | Octanoic Acid | 0.10 | SXS | 340 | 283 | 2 | 1C | 1C | 1 | 1 | 1 |
| 56 | 0.50 | 0.15 | Octanoic Acid | 0.20 | SXS | 210 | 175 | 1F | 1C | 1 | 1 | 1 | 1 |
| 57 | 0.50 | 0.20 | Octanoic Acid | 0.10 | SXS | 160 | 135 | 1F | 1C | 1 | 1 | 1 | 1 |
| 58 | 0.50 | 0.06 | Na Octylsulfonate | 0.06 | MNS | 200 | 182 | 2 | 2 | 2 | 1 | 1 | 1 |

CETAC = Cetyltrimethylammonium Chloride.
All formulas contain 0.113 wt. % of sodium silicate ($SiO_2/Na_2O$ = 3.22); 5.6–5.8 wt. % sodium hypochlorite; 4–5 wt. % sodium chloride and 1.7–1.8 wt. % sodium hydroxide
Viscosities were measured at 72–81° F. with a Brookfield rotoviscometer model LVTD using spindle #2.
4-CBA = 4-Chlorobenzoic Acid
SXS = Sodium Xylenesulfonate
BSA = Benzenesulfonic Acid
TSA = Toluenesulfonic Acid
4-CBSA = 4-Chlorobenzenesulfonic Acid
2-CBA = 2-Chlorobenzoic Acid
2,4-D = 2,4-Dichlorobenzoic Acid
4-NBA = 4-Nitrobenzoic Acid
MNS = Methylnaphthalenesulfonate
C = Cloudy
F = Frozen

COSURFACTANTS

Thickening can be enhanced, and low temperature phase stability improved, through the addition of a cosurfactant selected from the group consisting of amine oxides, betaines and mixtures thereof. The preferred cosurfactants are alkyl dimethyl amine oxides and alkyl betaines. The longest alkyl group of the amine oxide or betaine generally can be eight to eighteen carbons in length, and should be near the upper end of the range where cosurfactant levels are high. Useful amounts range from a trace (less than about 0.01%) to an amount about equal to that of the quat. Table III shows the the effect of adding cosurfactants on phase stability and viscosity.

For example, formula 11 in Table III shows that adding 0.04 weight percent of myristyl/cetyldimethylamine oxide to formula 19 of Table II about doubles the viscosity and decreases the low temperature phase stability limit by at least 15 degrees. Similar effects are seen by comparing formulas III-9 and III-10 with II-18 and formula III-12 with II-24. That betaines work as well is demonstrated by comparing formulas III-18 and III-19 with formula II-25. Such behavior is surprising since formulas 26 and 27 in Table III and the formulas in Table I show that these cosurfactants do not thicken with only the organic counterions as used in this invention. However, adding too much cosurfactant can decrease viscosity as shown by comparing formulas 3 with 4, and 13 with 14, in Table III.

TABLE III

Effect of Cosurfactants

| No. | CETAC Wt. % | Cosurfactant Wt. % | Cosurfactant Name | 4-CBA Wt. % | SXS Wt. % | Viscosity (cP) 3 rpm | Viscosity (cP) 30 rpm | Number of Phases as Indicated Temp. (°F.) 0 | 12 | 30 | 71 | 107 | 127 |
|---|---|---|---|---|---|---|---|---|---|---|---|---|---|
| 1 | 0.30 | 0.02 | Lauryl DMAO | 0.12 | 0.22 | 580 | 202 | 1F | 1 | 1 | 1 | 1 | 1 |
| 2 | 0.30 | 0.04 | Lauryl DMAO | 0.12 | 0.22 | 490 | 226 | 1F | 1 | 1 | 1 | 1 | 1 |
| 3 | 0.50 | 0.10 | Lauryl DMAO | 0.20 | 0 | 930 | 327 | 2 | 1C | 1 | 1 | 1 | 1 |
| 4 | 0.50 | 0.20 | Lauryl DMAO | 0.20 | 0 | 20 | 23 | | | | 1 | | |
| 5 | 0.24 | 0.06 | Myristyl DMAO | 0.08 | 0.14 | 480 | 165 | 1F | 1 | 1 | 1 | 1 | 1 |
| 6 | 0.24 | 0.08 | Myristyl DMAO | 0.08 | 0.14 | 530 | 183 | 1F | 1 | 1 | 1 | 1 | 1 |
| 7 | 0.30 | 0.03 | Myristyl DMAO | 0.10 | 0.18 | 520 | 193 | 1F | 1 | 1 | 1 | 1 | 1 |
| 8 | 0.30 | 0.06 | Myristyl DMAO | 0.10 | 0.18 | 760 | 230 | 1F | 1 | 1 | 1 | 1 | 1 |
| 9 | 0.30 | 0.15 | Myristyl/Cetyl DMAO | 0.08 | 0.08 | 940 | 295 | 2 | 2 | 1C | 1 | 1 | 1 |
| 10 | 0.30 | 0.25 | Myristyl/Cetyl DMAO | 0.08 | 0.08 | 750 | 313 | 2 | 2 | 1C | 1 | 1 | 1 |
| 11 | 0.30 | 0.04 | Myristyl/Cetyl DMAO | 0.10 | 0.10 | 1100 | 223 | 2 | 2 | 1 | 1 | 1 | 1 |
| 12 | 0.50 | 0.25 | Myristyl/Cetyl DMAO | 0.10 | 0.10 | 3800 | 779 | 2 | 2 | 1C | 1 | 1 | 1 |
| 13 | 0.50 | 0.10 | Myristyl/Cetyl DMAO | 0.20 | 0 | 3420 | 640 | 1F | 1C | 1 | 1 | 1 | 1 |
| 14 | 0.50 | 0.20 | Myristyl/Cetyl DMAO | 0.20 | 0 | 2540 | 545 | | | | 1 | | |
| 15 | 0.50 | 0.10 | Lauroyl Sarcosine | 0.12 | 0.35 | 380 | 355 | | 1C | 1 | 1 | 1 | 1 |
| 16 | 0.50 | 0.10 | Cetoylmethyltaurate | 0.12 | 0.35 | 200 | 196 | | 1C | 1C | 1 | 2 | 2 |
| 17 | 0.50 | 0.10 | Cetoylmethyltaurate | 0.12 | 0.70 | 230 | 214 | | 1C | 1C | 1 | 1 | 1 |
| 18 | 0.50 | 0.10 | Cetylbetaine | 0.12 | 0.35 | 580 | 456 | 1F | 1C | 1 | 1 | 1 | 2 |
| 19 | 0.50 | 0.10 | Laurylbetaine | 0.12 | 0.35 | 740 | 443 | | 1 | 1 | 1 | 1 | 1 |
| 20 | 0.42 | 0.08 | Dodecyl TAC | 0.15 | 0.35 | 450 | 339 | | 1 | 1 | 1 | 1 | 1 |
| 21 | 0.38 | 0.12 | Dodecyl TAC | 0.15 | 0.35 | 190 | 180 | | 1 | 1 | 1 | 1 | 1 |
| 22 | 0.42 | 0.08 | Coco TAC | 0.15 | 0.35 | 610 | 385 | | 1 | 1 | 1 | 1 | 1 |
| 23 | 0.38 | 0.12 | Coco TAC | 0.15 | 0.35 | 310 | 239 | | 1 | 1 | 1 | 1 | 1 |
| 24 | 0 | 0.50 | Dodecyl TAC | 0.15 | 0.35 | Thin | | | | | 1 | | |
| 25 | 0 | 1.00 | Dodecyl TAC | 0.30 | 0.35 | Thin | | | | | 1 | | |
| 26 | 0 | 0.25 | Myristyl/Cetyl DMAO | 0.10 | 0.10 | 1 | 5 | 1F | 1 | 1 | 1 | 1 | 1 |
| 27 | 0 | 0.50 | Laurylbetaine | 0.15 | 0.35 | 1 | 5 | | 1 | 1 | 1 | 1 | 1 |

DMAO = Dimethylamine oxide
TAC = Trimethylammonium Chloride
CETAC = Cetyltrimethylammonium Chloride
4-CBA = 4-Chlorobenzoic Acid
SXS = Sodium Xylenesulfonate
C = Cloudy
F = Frozen
All formulas contain 5.8 wt. % of sodium hypochlorite, 1.5 wt. % of sodium hydroxide, 4.5 wt. % sodium chloride, 0.25 wt. % sodium carbonate and 0.113 wt. % of sodium silicate ($SiO_2$/ $Na_2O$ = 3.22)
Viscosities were measured at 72-81° F. with a Brookfield rotoviscometer model LVTD using spindle #2.

In the second embodiment of the present invention a composition suitable for opening drains is provided comprising, in aqueous solution:

(a) a viscoelastic thickener; and (b) a cleaning active.

The viscoelastic thickener may be any such thickener yielding viscoelastic properties within the limits set out herein, and preferably is of the type as described for the first embodiment herein. Polymers, surfactants, colloids, and mixtures thereof, which impart viscoelastic flow properties to an aqueous solution, are also suitable. The viscoelasticity of the thickener advantageously imparts unusual flow properties to the cleaning composition. Elasticity causes the stream to break apart and snap back into the bottle at the end of pouring instead of forming syrupy streamers. Further, elastic fluids appear more viscous than their viscosity indicates. Instruments capable of performing oscillatory or controlled stress creep measurements can be used to quantify elasticity. Some Parameters can be measured directly (see Hoffmann and Rehage, *Surfactant Science Series,* 1987, Vol. 22, 299–239 and EP 204,472), or they can be calculated using models. Increasing relaxation times indicate increasing elasticity, but elasticity can be moderated by increasing the resistance to flow. Since the static shear modulus is a measure of the resistance to flow, the ratio of the relaxation time (Tau) to the static shear modulus (G0) is used to measure relative elasticity. Tau and G0 can be calculated from oscillation data using the Maxwell model. Tau can also be calculated by taking the inverse of the frequency with the maximum loss modulus. G0 is then obtained by dividing the complex viscosity by Tau. To obtain the full benefits of the viscoelastic thickener, the Tau/G0 (relative elasticity) should be greater than about 0.03 sec/Pa.

Some consumers do not like the appearance of elastic flow properties. Thus, for certain products the elasticity should be minimized. It has been empirically determined that good consumer acceptance is usually obtained for solutions with Tau/G0 less than about 0.5 sec/Pa, although much higher relative elasticities can be formulated. The relative elasticity can be varied by varying the types and concentrations of quat and counterions, and by adjusting the relative concentrations of counterions and quat.

Table IV shows the effect of composition on rheology and corresponding drain cleaning performance. The latter is measured by two parameters: (1) percentage delivery: and (2) flow rate. Percentage delivery was measured by pouring 20 mL of the composition, at 73° F., into 80 mL of standing water, and measuring the amount of undiluted product delivered. Flow rate was measured by pouring 100 mL of the composition through a No. 230 US mesh screen and recording the time to pass through the screen. A delivery of 0% indicates that only diluted product, if any, has reached the clog; a 100% delivery indicates that all of the product, substantially undiluted, has reached the clog. Rheology was measured with a Bolin VOR rheometer at 77 ° F. in the oscillatory mode. The viscosity is the in-phase component extrapolated to 0 Herz. The relaxation time, Tau, and the static shear modulus, G0, were calculated using the Maxwell model. The ratio Tau/G0 is, as previously described, postulated to be a measure of relative elasticity.

TABLE IV

Effect of Composition on Reheology and Drain Opener Performance.

| No. | CETAC Wt. % | SXS Wt. % | Counterion Wt. % | Counterion Type | Viscosity cP | Tau sec | GO Pa | Tau/GO sec/Pa | Delivery % | Flow Rate mL/min |
|---|---|---|---|---|---|---|---|---|---|---|
| 1 | 0.370 | 0.260 | 0.080 | CBA | 47 | 0.33 | 0.93 | 0.35 | — | — |
| 2 | 0.500 | 0.143 | 0.071 | CBA | 247 | 0.84 | 1.86 | 0.45 | 96 | 46 |
| 3 | 0.500 | 0.286 | 0.071 | CBA | 84 | 0.20 | 2.66 | 0.08 | 73 | 150 |
| 4 | 0.500 | 0.350 | 0.120 | CBA | 153 | 0.47 | 2.11 | 0.22 | 96 | 33 |
| 5 | 0.500 | 0.315 | 0.132 | CBA | 560 | 1.29 | 1.83 | 0.71 | — | — |
| 6 | 0.625 | 0.125 | 0.063 | CBA | 716 | 2.00 | 2.25 | 0.89 | 96 | 27 |
| 7 | 0.625 | 0.250 | 0.063 | CBA | 140 | 0.23 | 3.94 | 0.06 | 74 | 109 |
| 8 | 0.625 | 0.313 | 0.156 | CBA | 390 | 0.67 | 3.65 | 0.18 | 96 | 26 |
| 9 | 0.625 | 0.625 | 0.156 | CBA | 302 | 0.53 | 3.63 | 0.15 | 86 | 33 |
| 10 | 0.670 | 0.310 | 0.085 | CBA | 142 | 0.20 | 4.56 | 0.04 | — | 43 |
| 11 | 0.750 | 0.225 | 0.075 | CBA | 327 | 0.44 | 4.77 | 0.09 | 87 | 67 |
| 12 | 0.750 | 0.214 | 0.107 | CBA | 478 | 0.66 | 4.57 | 0.14 | 95 | 34 |
| 13 | 0.750 | 0.428 | 0.107 | CBA | 147 | 0.16 | 5.68 | 0.03 | 78 | 100 |
| 14 | 0.750 | 0.562 | 0.188 | CBA | 587 | 0.69 | 5.36 | 0.13 | 94 | 27 |
| 15 | 0.100 | 0.050 | 0.050 | NA | 7 | 0.08 | 0.23 | 0.35 | 74 | 133 |
| 16 | 0.150 | 0.050 | 0.050 | NA | 26 | 0.26 | 0.26 | 1.00 | 82 | 80 |
| 17 | 0.200 | 0.100 | 0.050 | NA | 21 | 0.64 | 0.22 | 2.91 | 90 | 120 |
| 18 | 0.200 | 0.100 | 0.100 | NA | 43 | 0.98 | 0.24 | 4.08 | 90 | 46 |
| 19 | 0.400 | 0.200 | 0.100 | NA | 71 | 0.42 | 1.07 | 0.39 | 94 | 52 |
| 20 | 0.600 | 0.200 | 0.100 | NA | 244 | 0.60 | 2.64 | 0.23 | 97 | 27 |
| 21 | 0.400 | 0.130 | 0.160 | BA | 116 | 0.83 | 0.83 | 0.99 | 91 | 48 |
| 22 | 0.500 | 0.200 | 0.290 | BA | 166 | 0.73 | 1.41 | 0.52 | 94 | 32 |
| 23 | 0.600 | 0.240 | 0.160 | BA | 94 | 0.27 | 2.32 | 0.12 | 81 | 71 |
| 24 | 0.600 | 0.300 | 0.380 | BA | 128 | 0.36 | 2.32 | 0.16 | 93 | 34 |
| 25 | 0.600 | 0.250 | 0.150 | TA | 137 | 0.26 | 3.22 | 0.08 | 91 | 63 |
| 26 | 0.600 | 0.400 | 0.150 | TA | 46 | 0.13 | 2.20 | 0.06 | 68 | 109 |
| 27 | 0.600 | 0.400 | 0.300 | TA | 178 | 0.42 | 2.62 | 0.16 | 93 | 36 |

CETAC = Cetyltrimethylammonium Chloride;
SXS = Sodium Xylenesulfonate;
CBA = 4-Chlorobenzoic Acid;
NA = 1-Naphthoic Acid;
BA = Benzoic Acid;
TA = 4-Toluic Acid.
All formulas contain 5.8 wt. % sodium hypochlorite NaOCl, 4.55 wt. % Cl sodium chloride, 0.25 wt. % sodium carbonate, 1.5 wt. % sodium hydroxide, and 0.113 wt. % of sodium silicate ($SiO/Na_2O$ = 3.22).

The viscoelastic compositions herein represent a substantial departure from compositions of the prior art in that elasticity, rather than simply viscosity, is the crucial parameter to the success of the invention. The viscoelastic thickener provides surprising advantages when formulated as a drain cleaner. Because the elastic components hold the solution together, it will travel through standing water with very little dilution, delivering a high percentage of active to the clog. The elasticity results in a higher delivery rate of active than a purely viscous solution of the same viscosity. This is true even if the viscosity of the solution is low. Thus, viscosity alone will not result in good performance, but elasticity alone will, and a solution which is elastic and has some viscosity will result in superior performance. Such purely viscous solutions, furthermore, do not achieve their highest delivery rates unless the viscosity is very high (above about 1000 cP). This presents other problems, including difficulty in dispensing at low temperatures, poor penetration into clogs, reduced consumer acceptance, and high cost associated with attaining such high viscosities. The elasticity also yields increased percolation times through porous or partial clogs, surprisingly increasing the effectiveness of a drain opening composition.

Table V compares performance vs. rheology for five formulations: an unthickened control, a sarcosinate, non-viscoelastic thickened formulation, a slightly viscoelastic formulation of a surfactant and a soap, and two viscoelastic formulations of the present invention. The delivery and flow rate parameters were measured as in Table IV.

TABLE V

Performance Versus Rheology

| Formula | Rheology | Viscosity cP | Tau sec | G0 Pa | Tau/G0 sec/Pa | Delivery[b] % | Flow Rate[c] mL/min |
|---|---|---|---|---|---|---|---|
| 1 | unthickened | 1 | 0 | 0 | 0 | 0 | 2400 |
| 2 | thickened nonelastic | 141 | 0.12 | 7.64 | 0.016 | 6 | 92 |
| 3 | smooth | 334 | 0.35 | 6.06 | 0.058 | 47 | 52 |
| 4 | elastic | 140 | 0.26 | 3.48 | 0.075 | 93 | 55 |
| 5 | elastic | 153 | 0.47 | 2.11 | 0.223 | 96 | 33 |

| Formula | Wt. % | Compound | Wt. % | Compound | Wt. % | Compound |
|---|---|---|---|---|---|---|
| 1 | | | contains not thickeners | | | |
| 2 | 1.6 | MDMAO | 0.37 | Sarcosinate[1] | 0.03 | Primacor 5980[2] |

TABLE V-continued

| Performance Versus Rheology | | | | | | |
|---|---|---|---|---|---|---|
| 3 | 0.8 | MDMAO | 0.25 | Lauric Acid | — | — |
| 4 | 0.62 | CETAC | 0.09 | 4-CBA | 0.35 | SXS |
| 5 | 0.50 | CETAC | .12 | 4-CBA | 0.35 | SXS |

[b]Percentage of product that passes through standing water to the clog. Twenty mL of product at 73° F. was poured into 80 mL of standing water.
[c]Rate of Flow for product at 73° F. through a 230 mesh sieve.
[1]Sodium lauroyl sarcosinate
[2]A trademarked product of the Dow Chemical Co., comprising a copolymer of acrylic acid and ethylene
All formulas contain 5.8 wt. % sodium hypochlorite, 1.75 wt. % sodium hydroxide and 0.11 wt. % sodium silicate ($SiO_2/Na_2O$ = 3.22).
MDMAO = Myristyldimethylamine oxide
CETAC = Cetyltrimethyl ammonium chloride
4-CBA = 4-chlorobenzoic acid
SXS = Sodium Xylenesulfonate From Table V, it can be seen that formulas 1 and 2, which are not viscoelastic, have very low delivery values and high flow rates. This is true even though formula 2 is moderately thickened. The formulas of Table IV show that at a Tau/G0 of about 0.03 or greater, a preferred delivery percentage of above about 75% is attained. More preferred is a delivery percentage of above about 90%. Thus, relative elasticities of above about 0.03 sec/Pa are preferred, and more preferred are values of above about 0.05 sec/Pa. A most preferred relative elasticity is above about 0.07 sec/Pa. A preferred flow rate is less than about 150 mL/minute, more preferred is less than about 100 mL/minute. It can also be seen from Tables IV and V that the relative elasticity of the composition, rather than viscosity, is crucial to drain opener performance. Comparing, for example, formulas 3 with 4 of Table V, shows that despite having only about half the viscosity, formula 4, with a slightly higher relative elasticity, far outperformed formula 3. Formulas 15 and 17 of Table IV also show that low viscosity formulas can display good drain opening performance as long as sufficient relative elasticity is present.

It is noted that viscosities reported herein are shear viscosities, i.e. those measured by a resistance to flow perpendicular to the stress vector. However, the parameter which most accurately defines the rheology of the present invention is extensional viscosity, i.e. uniaxial resistance to flow along the stress vector. Because a means of directly measuring extensional viscosity in solutions as described herein is not yet available, the relative elasticity parameter (Tau/G0) is used as an approximation. It is noted that if a means of measuring extensional viscosity becomes available, such means could be used to further define the scope of the present invention.

The maximum benefits of the viscoelastic rheology of the drain cleaning composition of the present invention are attained when the composition is denser than water, enabling it to penetrate standing water. While less dense compositions still benefit from the viscoelastic rheology when applied to drains having porous or partial clogs, the full benefit is obtained when the composition possesses a density greater than water. In many instances, this density is attained without the need for a densifying material. In formulations containing sodium hypochlorite, for example, sufficient sodium chloride is present with the hypochlorite to afford a density greater than water. When necessary to increase the density, a salt such as sodium chloride is preferred and is added at levels of 0 to about 20%.

The cleaning active is an acid, base, solvent, oxidant, reductant, enzyme, surfactant or thioorganic compound, or mixtures thereof, suitable for opening drains. Such materials include those as previously described in the first embodiment which act by either chemically reacting with the clog material to fragment it or render it more water-soluble or dispersable, physically interacting with the clog material by, e.g., adsorption, absorption, solvation, or heating (i.e. to melt grease), or by enzymatically catalyzing a reaction to fragment or render the clog more water-soluble or dispersable. Particularly suitable are alkali metal hydroxides and hypochlorites. Combinations of the foregoing are also suitable. The drain opener may also contain various adjuncts as known in the art, including corrosion inhibitors, dyes and fragrances A preferred example of a drain cleaning formulation includes:

(a) an alkyl quaternary ammonium compound having at least a $C_{14}$ alkyl group;
(b) an organic counterion;
(c) an alkali metal hydroxide;
(d) an alkali metal silicate;
(e) an alkali metal carbonate; and
(f) an alkali metal hypochlorite Components (a) and (b) comprise the viscoelastic thickener and are as described previously in the first embodiment. The alkali metal hydroxide is preferably potassium or sodium hydroxide, and is present in an amount of between about 0.5 and 20% percent. The preferred alkali metal silicate is one having the formula $M_2O(SiO)_n$ where M is an alkali metal and n is between 1 and 4. Preferably M is sodium and n is 2.3. The alkali metal silicate is present in an amount of about 0 to 5 percent. The preferred alkali metal carbonate is sodium carbonate, at levels of between about 0 and 5 percent. About 1 to 10.0 percent hypochlorite is present, preferably about 4 to 8.0 percent.

In a third embodiment, a viscoelastic hypochlorite cleaning composition is provided and comprises, in aqueous solution (a) a quaternary ammonium compound;
(b) an organic counterion; and
(c) a hypochlorite bleaching species.

The composition of the third embodiment may have utility as a hard surface cleaner. Hypochlorite may also be incorporated into a drain opening composition, as previously described. The thick solutions are clear and transparent, and can have higher viscosities than hypochlorite solutions of the art. Because viscoelastic thickening is more efficient, less surfactant is needed to attain the viscosity, and chemical and physical stability of the composition generally is better. Less surfactant also results in a more cost-effective composition. As a hard surface cleaner, the viscoelastic rheology prevents the composition from spreading on horizontal sources and thus aids in protecting nearby bleach-sensitive surfaces. The viscoelasticity also provides the benefits of a thick system e.g. increased residence time on nonhorizontal surfaces. Generally, the preferred quat for use with hypochlorite (or other source of ionic strength) is an alkyl trimethyl quaternary ammonium compound having a 14 to 18 carbon alkyl group, and most preferably the quat is CETAC. Owing to the relatively high ionic strength of the hypochlorite, it is preferred that $R_1$, $R_2$ and $R_3$ be relatively small, and methyls are more preferred. In the presence of hypochlorite, the composition is most stable when no more than about 1.0 weight percent quat is present, although up to about 10 weight percent quat can be used. Substituted benzoic acids are preferred as the counterion with 4-chlorobenzoic acid being more preferred. Most preferred are mixtures of 4-chlorobenzoic acid or 4-toluic acid with a sulfonate counterion, such as sodium xylenesulfonate. In the presence of bleach, hydroxyl, amino, and carbonyl substituents on the counterion should be avoided. Table VI shows hypochlorite and viscosity stability for various formulations having mixtures of counterions.

TABLE VI

| | | | | Stability at 120° F. | | | | | | |
|---|---|---|---|---|---|---|---|---|---|---|
| | CETAC | Counterion | | Counterion | | Viscosity | % Remaining at 120° F. Viscosity | | % Remaining at 120° F. NaOCl | |
| No. | Wt. % | Wt. % | Name | Wt. % | Name | cP | 1 wk | 2 wk | 1 wk | 2 wk |
| 1 | 0.50 | 0.20 | BSA | 0.10 | 4-NBA | 206 | 75 | | 75 | |
| 2 | 0.50 | 0.20 | BSA | 0.20 | Benzoic Acid | 136 | 95 | | 75 | |
| 3 | 0.50 | 0.20 | BSA | 0.15 | SXS | 135 | 74 | | 74 | |
| 4 | 0.50 | 0.05 | 4-CBSA | 0.10 | 4-NBA | 200 | 75 | | 75 | |
| 5 | 0.50 | 0.05 | 4-CBSA | 0.10 | Benzoic Acid | 158 | 96 | | 74 | |
| 6 | 0.50 | 0.05 | 4-CBSA | 0.30 | Benzoic Acid | 205 | 94 | | 75 | |
| 7 | 0.50 | 0.05 | 4-CBSA | 0.15 | SXS | 82 | 76 | | 76 | |
| 8 | 0.30 | 0.12 | 4-CBA | 0.30 | SXS | 184 | 93 | 63 | | 60 |
| 9 | 0.40 | 0.12 | 4-CBA | 0.28 | SXS | 300 | 82 | 74 | | 60 |
| 10 | 0.52 | 0.09 | 4-CBA | 0.29 | SXS | 180 | 91 | 98 | 79 | 64 |
| 11 | 0.50 | 0.12 | 4-CBA | 0.28 | SXS | 346 | 99 | | | |
| 12 | 0.50 | 0.15 | 4-CBA | 0.35 | SXS | 413 | 93 | 67 | | 59 |
| 13 | 0.62 | 0.09 | 4-CBA | 0.29 | SXS | 235 | 85 | 85 | 76 | 60 |
| 14 | 0.72 | 0.04 | 4-CBA | 0.29 | SXS | 316 | 77 | 76 | 78 | 62 |
| 15 | 0.30 | 0.05 | NA | 0.05 | SXS | 118 | 44 | | 76 | |
| 16 | 0.30 | 0.10 | NA | 0.10 | SXS | 120 | 48 | | 76 | |
| 17 | 0.48 | 0.21 | SA | | None | 280 | 0 | | | |
| | Control | None | | | None | | | | 79 | 65 |

All formulas contain 5.2–5.8 wt. % sodium hypochlorite, 1.6–1.8 wt. % sodium hydroxide, about 4–5 wt. % sodium chloride, 0.25 wt. % sodium carbonate and 0.113 wt. % of sodium silicate ($SiO_2$/ $Na_2O$ = 3.22).
Viscosities were measured at 72–76° F. with a Brookfield rotoviscometer model LVTD using spindle #2 at 30 rpm.
4-CBA = 4-Chlorobenzoic Acid
4-CBSA = 4-Chlorobenzenesulfonic Acid
SXS = Sodium Xylenesulfonate
2-CBA = 2-Chlorobenzoic Acid
BSA = Benzenesulfonic Acid
NA = Naphthoic Acid
SA = Salicylic Acid
4-NBA = 4-Nitrobenzoic Acid Table VIII shows the mixture of carboxylate and sulfonate counterions results in a significant improvement in viscosity stability, as well as phase stability, over formulations of the art containing equal levels of hypochorite. Formulas 1 and 2, are compositions of the present invention and retain essentially all of their initial viscosity after two weeks at 106° F., with formula 2 showing only a slight decrease after 12 weeks at 106° F. By comparison, none of the formulations of the art retained even one-half of their initial viscosity after 12 weeks at 106° F.

TABLE VII

| Viscosity Stability Compared to Other Formulas | | | | | | |
|---|---|---|---|---|---|---|
| | Initial Viscosity | Percent Viscosity Left Weeks at 106° F. | | | | |
| Thickening System | cP | 1 | 2 | 4 | 8 | 12 |
| 1 | 320 | 101 | 99 | N/A | 104 | 100 |
| 2 | 203 | N/A | 94 | N/A | 87 | 84 |
| 3 | 358 | 85 | 92 | 74 | 63 | N/A |
| 4 | 309 | N/A | 96 | 56 | 53 | 42 |
| 5 | 304 | N/A | 57 | 29 | 16 | 11 |
| 6 | 335 | N/A | 77 | 64 | 49 | 45 |

All formulas contain 4.5–5.8 wt. % of sodium hypochlorite, 1.5–1.8 wt. % of sodium hydroxide, 3.5–4.6 wt. % of sodium chloride, 0.25 wt. % of sodium carbonate, and 0.11–0.45 wt. % of sodium silicate ($SiO_2/Na_2O$ = 3.22).
Viscosities were measured at 72–75° F. with a Brookfiled rotoviscometer model LVTD using cylindrical spindle #2 at 30 rpm.
(1) contains 0.5 wt. % Cetyltrimethylammonium Chloride, 0.12 wt. % 4-Chlorobenzoic acid and 0.35 wt. % Sodium xylene sulfonate.
(2) contains 0.62 wt. % Cetyltrimethylammonium Chloride, 0.09 wt. % 4-Chlorobenzoic acid and 0.29 wt. % Sodium xylene sulfonate.
(3) contains 0.97 wt. % Sodium lauryl sulfate, 0.30 wt. % Sodium lauroyl sarcosinate and 0.30 wt. % Sodium lauryl ether sulfate.
(4) contains 0.60 wt. % Myristyl/cetyldimethylamine oxide, 0.20 wt. % Capric acid and 0.10 wt. % Lauric acid.
(5) contains 0.65 wt. % Myristyl/cetyldimethylamine oxide and 0.20 wt. % Sodium alkylnaphthalene sulfonate.
(6) contains 1.00 wt. % Myristyl/cetyldimethylamine oxide, 0.25 wt. % Sodium xylene sulfonate and 0.35 wt. % Disodium dodecyldiphenyl oxide disulfonate.

A bleach source may be selected from various hypochlorite-producing species, for example, halogen bleaches selected from the group consisting of the alkali metal and alkaline earth salts of hypohalite, haloamines, haloimines, haloimides and haloamides. All of these are believed to produce hypohalous bleaching species in situ. Hypochlorite and compounds producing hypochlorite in aqueous solution are preferred, although hypobromite is also suitable. Representative hypochlorite-producing compounds include sodium, Potassium, lithium and calcium hypochlorite, chlorinated trisodium phosphate dodecahydrate, potassium and sodium dicholoroisocyanurate and trichlorocyanuric acid. Organic bleach sources suitable for use include heterocyclic N-bromo and N-chloro imides such as trichlorocyanuric and tribromo-cyanuric acid, dibromo- and dichlorocyanuric acid, and potassium and sodium salts thereof, N-brominated and N-chlorinated succinimide, malonimide, phthalimide and naphthalimide. Also suitable are hydantoins, such as dibromo and dichloro dimethyl-hydantoin, chlorobromodimethyl hydantoin, N-chlorosulfamide (haloamide) and chloramine (haloamine). Particularly preferred in this invention is sodium hypochlorite having the chemical formula NaOCl, in an amount ranging from about 0.1 weight percent to about 15 weight percent, more preferably about 0.2% to 10%, and most preferably about 2.0% to 6.0%.

Advantageously, the viscoelastic thickener is not diminished by ionic strength, nor does it require ionic strength for thickening. Suprisingly, the viscoelastic compositions of the present invention are phase-stable and retain their rheology in solutions with more than about 0.5 weight percent ionizable salt, e.g., sodium chloride and sodium hypochlorite, corresponding to an ionic strength of about 0.09 g-ions/Kg solution. Suprisingly, the composition rheology remained stable at levels of ionizable salt of between about 5 and 20 percent, corresponding to an ionic strength of between about 1–4 g-ions/Kg. It is expected that the viscoelastic rheology would remain even at ionic strengths of at least about 6 g-ions/Kg. Table VIII shows the effects of a salt on viscosity and phase stability for a hypochlorite containing composition of the present invention.

TABLE VIII

| | Weight Percent | | | |
|---|---|---|---|---|
| | 1 | 2 | 3 | 4 |
| Formula | | | | |
| CETAC | 0.50 | 0.50 | 0.50 | 0.50 |
| 4-Chlorobenzoic Acid | 0.13 | 0.13 | 0.13 | 0.13 |
| Sodium Xylenesulfonate | 0.32 | 0.32 | 0.32 | 0.32 |
| Sodium Hypochlorite | 5.80 | 5.80 | 5.80 | 5.80 |
| Sodium Hydroxide | 1.75 | 1.75 | 1.75 | 1.75 |
| Sodium Silicate ($SiO_2$/ $Na_2O$ = 3.22) | 0.11 | 0.11 | 0.11 | 0.11 |
| Sodium Carbonate | 0.25 | 0.25 | 0.25 | 0.25 |
| Sodium Chloride[a] | 4.55 | 5.80 | 7.05 | 9.55 |
| Ionic Strength, g-ions/Kg | 2.42 | 2.71 | 3.00 | 3.61 |
| Viscosity[b], cP | | | | |
| 3 rpm | 600 | 680 | 820 | 1120 |
| 30 rpm | 385 | 386 | 384 | 388 |
| Number of Phases | | | | |
| 10° F. | 1C | 1C | 1 | 1 |
| 30° F. | 1 | 1 | 1 | 1 |
| 70° F. | 1 | 1 | 1 | 1 |
| 100° F. | 1 | 1 | 1 | 1 |
| 125° F. | 2 | 1 | 1 | 1 |

[a]Includes salt from the manufacturer of sodium hypochlorite.
[b]Viscosities were measured at 72° F. with a Brookfield rotoviscometer model LVTD using spindle #2.
C = Cloudy

OPTIONAL INGREDIENTS

Buffers and pH adjusting agents may be added to adjust or maintain pH. Examples of buffers include the alkali metal phsophates, polyphosphates, pyrophosphates, triphosphates, tetraphosphates, silicates, metasilicates, polysilicates, carbonates, hydroxides, and mixtures of the same. Certain salts, e.g., alkaline earth phosphates, carbonates, hydroxides, etc., can also function as buffers. It may also be suitable to use as buffers such materials as aluminosilicates (zeolites), borates, aluminates and bleach-resistant organic materials, such as gluconates, succinates, maleates, and their alkali metal salts. These buffers function to keep the pH ranges of the present invention compatable with the cleaning active, depending on the embodiment. Control of pH may be necessary to maintain the stability of the cleaning active, and to maintain the counterion in anionic form. In the first instance, a cleaning active such as hypochlorite is maintained above about pH 10, preferably above or about pH 12. The counterions, on the other hand, generally don't require a pH higher than about 8 and may be as low as pH 5–6. Counterions based on strong acids may tolerate even lower pH's. The total amount of buffer including that inherently present with bleach plus any added, can vary from about 0.0% to 25%.

The composition of the present invention can be formulated to include such components as fragrances, coloring agents, whiteners, solvents, chelating agents and builders, which enhance performance, stability or aesthetic appeal of the composition. From about 0.01% to about 0.5% of a fragrance such as those commercially available from International Flavors and Fragrance, Inc. may be included in any of the compositions of the first, second or third embodiments. Dyes and pigments may be included in small amounts. Ultramarine Blue (UMB) and copper phthalocyanines are examples of widely used pigments which may be incorporated in the composition of the present invention. Suitable builders which may be optionally included comprise carbonates, phosphates and pyrophosphates, exemplified by such builders function as is known in the art to reduce the concentration of free calcium or magnesium ions in the aqueous solution. Certain of the previously mentioned buffer materials, e.g. carbonates, phosphates, phosphonates, polyacrylates and pyrophosphates also function as builders.

While described in terms of the presently preferred embodiment, it is to be understood that such disclosure is not to be interpreted as limiting. Various modifications and alterations will no doubt occur to one skilled in the art after having read the above disclosure. Accordingly, it is intended that the appended claims be interpreted as covering all such modifications and alterations as fall within the true spirit and scope of the invention.

I claim:

1. A thickened cleaning composition having a viscoelastic rheology comprising, in aqueous solution (a) an active cleaning compound, present in a cleaning effective amount; and (b) a viscoelastic thickening system present in a thickening-effective amount, consisting essentially of a quaternary ammonium compound selected from the group consisting of those having the following structures:

(i) 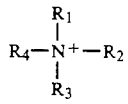

(ii) 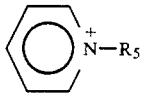 and;

(iii) mixtures thereof;

wherein $R_1$, $R_2$ and $R_3$, are the same or different and are methyl, ethyl, propyl, isopropyl or benzyl, $R_4$ is $C_{14-18}$ alkyl, and $R_5$ is $C_{14-18}$ alkyl; and an organic counterion mixture, comprising at least one sulfonate and one carboxylate selected from the group consisting of $C_{2-10}$ alkyl carboxylates, aryl carboxylates, $C_{2-10}$ alkyl sulfonates, aryl sulfonates, sulfated $C_{2-10}$ alcohols, sulfated aryl alcohols, and mixtures thereof, the sulfonate and carboxylate being present in a ratio of about 1:6 to 6:1 and wherein the resulting composition is phase stable and has an ionic strength of at least about 0.09 g-ions/kg.

2. The composition of claim 1 wherein the active cleaning compound comprises acids, bases, oxidants, reductants, solvents, enzymes, detergents, thioorganic compounds, and mixtures thereof.

3. The composition of claim 1 wherein the quaternary ammonium compound is an alkyltrimethyl ammonium compound having a 14–18 carbon alkyl group, and the organic counterion mixture includes a carboxylate-containing counterion and a sulfonate-containing counterion.

4. The composition of claim 1 wherein the aryl counterion is benzene, naphthalene or $C_{1-4}$ alkyl, alkoxy, halogen or nitro substituted benzene or naphthalene.

5. The composition of claim 1 wherein the composition has a relative elasticity of greater than about 0.03 sec/Pa.

6. The composition of claim 5 wherein component (a) is present in an amount of from about 0.05% to 50%; component (b) is present from about 0.11 to 20%; and the organic counterion mixture is present in a mole ratio to the quaternary ammonium compound of between about 6:1 and 1:12.

7. A thickened viscoelastic drain opening composition comprising, in aqueous solution: (a) a drain opening effective amount of a drain opening active; and: (b) a viscoelastic thickening system consisting essentially of a quaternary ammonium compound, selected from the group consisting of:

(i) 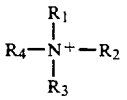

(ii) 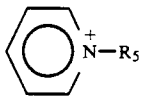 and;

(iii) mixtures thereof;

wherein $R_1$, $R_2$ and $R_3$ are the same or different and are methyl, ethyl, propyl, isopropyl, or benzyl, $R_4$ is $C_{14-18}$ alkyl, and $R_5$ is $C_{14-18}$ alkyl; and an organic counterion selected from the group consisting of $C_{2-10}$ alkyl carboxylates, aryl carboxylates, $C_{2-10}$ alkyl sulfonates, and aryl sulfonates, sulfated $C_{2-10}$ alkyl alcohols, sulfated aryl alcohols and mixtures thereof; and wherein the composition has a relative elasticity of greater than about 0.03 sec/Pa, a delivery rate of greater than about 75%, as determined by pouring a first quantity of composition into a second quantity of standing water and measuring an amount of undiluted product delivered, and a flow rate of less than about 150 ml/minute through a U.S. 230 mesh screen.

8. The composition of claim 7 wherein the organic counterion comprises a mixture of at least one carboxylate-containing counterion and at least one sulfonate-containing counterion.

9. A thickened viscoelastic drain opening composition comprising, in aqueous solution (a) an alkali metal hydroxide;

(b) at least about 0.2% of an alkali metal hypochlorite; and (c) a viscoelastic thickening system, present in a thickening-effective amount, and consisting essentially of quaternary ammonium compound having the following structure:

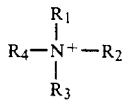

wherein $R_1$, $R_2$ and $R_3$ are the same or different and are methyl, ethyl, propyl, isopropyl or benzyl, $R_4$ is $C_{14-18}$ alkyl; and an organic counterion, selected from the group consisting of $C_{2-10}$ alkyl carboxylates, aryl carboxylates, $C_{2-10}$ alkyl sulfonates, aryl sulfonates, sulfated $C_{2-10}$ alkyl alcohols, sulfated aryl alcohols and mixtures thereof; and wherein the resulting composition is phase stable and has an ionic strength of at least about 0.09 g-ions/Kg, a relative elasticity of greater than about 0.03 sec/Pa, a delivery rate of greater than about 75%, as determined by pouring a first quantity of composition into a second quantity of standing water and measuring an amount of undiluted product delivered, and a flow rate of less than about 150 ml/minute through a U.S. 230 mesh screen.

10. The drain opening composition of claim 9 and further including 0 to about 5 weight percent of an alkali metal silicate, and 0 to about 5 weight percent of an alkali metal carbonate.

11. The composition of claim 9 wherein component (a) is present in an amount of from about 0.5 to 20 weight percent; component (b) is present in an amount of from about 1 to 10 weight percent; component (c) is present from about 0.1 to 10 weight percent; and component (d) is present from about 0.01 to about 10 weight percent.

12. A thickened viscoelastic hypochlorite composition comprising, in aqueous solution (a) a hypochlorite-producing source, present in an amount sufficient to produce a bleaching-effective amount of hypochlorite; and (b) thickening-effective amount of a viscoelastic thickening system comprising a quaternary ammonium compound, selected from the group consisting of:

(i) 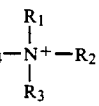

-continued (ii) 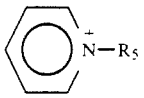 and;

(iii) mixtures thereof;

wherein $R_1$, $R_2$ and $R_3$ are the same or different and are methyl, ethyl, propyl, isopropyl, or benzyl, $R_4$ is $C_{14-18}$ alkyl, and $R_5$ is $C_{14-18}$ alkyl; and an organic counterion mixture of at least one sulfonate and one carboxylate selected from the group consisting of $C_{2-10}$ alkyl carboxylates, aryl carboxylates, $C_{2-10}$ alkyl alcohols, and mixtures thereof; and a ratio of sulfonate:carboxylate is about 1:6 to 6:1 and wherein the resulting composition is phase stable and has an ionic strength of at least about 0.09 g-ions/kg.

13. The composition of claim 12 wherein the composition has a relative elasticity of greater than about 0.03 sec/Pa, and a viscosity of at least about 20 cP.

14. The composition of claim 12 wherein component (a) is present from abut 0.1 to 15 weight percent; and component (b) is present from about 0.11 to 20 weight percent; and a mole ratio of the quaternary ammonium compound to the organic counterion is between about 12:1 and 1:6.

* * * * *